US005329909A

United States Patent [19]

Hosoda et al.

[11] Patent Number: 5,329,909

[45] Date of Patent: Jul. 19, 1994

[54] EVAPORATIVE FUEL-PURGING CONTROL SYSTEM FOR INTERNAL COMBUSTION ENGINES

[75] Inventors: Fumio Hosoda; Masayuki Habaguchi; Kazuhito Kakimoto; Toru Tochizawa; Masashi Uchiyama; Yoshiharu Ave, all of Wako, Japan

[73] Assignee: Honda Giken Kogyo Kabushiki Kaisha, Tokyo, Japan

[21] Appl. No.: 90,244

[22] Filed: Jul. 7, 1993

Related U.S. Application Data

[63] Continuation of Ser. No. 853,288, Mar. 18, 1992, abandoned.

[30] Foreign Application Priority Data

Mar. 19, 1991 [JP] Japan ..... 3-80725

[51] Int. Cl.[5] ..... F02M 33/02

[52] U.S. Cl. ..... 123/520; 123/494

[58] Field of Search ..... 123/520, 519, 521, 516, 123/518, 198 D, 357-359, 494

[56] References Cited

U.S. PATENT DOCUMENTS

| | | | |
|---|---|---|---|
| 4,493,303 | 1/1985 | Thompson | 123/357 |
| 4,537,172 | 8/1985 | Kanehara | 123/494 |
| 4,862,856 | 9/1989 | Yokoe | 123/520 |
| 4,867,126 | 9/1989 | Yonekawa | 123/148 B |
| 4,949,695 | 8/1990 | Uranishi | 123/494 |
| 4,949,860 | 7/1990 | Chujo | 123/494 |
| 4,961,412 | 10/1990 | Foruyama | 123/357 |
| 4,962,749 | 10/1990 | Uranashi | 123/494 |
| 5,067,461 | 11/1991 | Joachim | 123/358 |
| 5,085,197 | 2/1992 | Mader | 123/520 |

FOREIGN PATENT DOCUMENTS

| | | |
|---|---|---|
| 63-131962 | 6/1987 | Japan . |
| 63-111277 | 5/1988 | Japan . |

*Primary Examiner*—Carl S. Miller

*Attorney, Agent, or Firm*—Nikaido, Marmelstein, Murray & Oram

[57] ABSTRACT

An evaporative fuel-purging control system for an internal combustion engine includes a mass flowmeter arranged across a purging passage of the engine for measuring a flow rate of a mixture of evaporative fuel and air being purged. A desired flow rate of the mixture is set according to operating conditions of the engine. The desired flow rate of the mixture is compared with a measured flow rate of the mixture obtained by the mass flowmeter, and the opening of a purge control valve arranged across the purging passage is controlled based on results of the comparison.

10 Claims, 4 Drawing Sheets

EVAPORATIVE FUEL-PURGING CONTROL SYSTEM FOR INTERNAL COMBUSTION ENGINES

This application is a continuation of application Ser. No. 07/853,288 filed Mar. 18, 1992 now abandoned.

BACKGROUND OF THE INVENTION

1. Field of the Invention

This invention relates to an evaporative fuel-purging control system for an internal combustion engine having an evaporative emission control system.

2. Prior Art

Conventionally, evaporative emission control systems have been widely used in internal combustion engines, which operate to prevent evaporative fuel (fuel vapor) from being emitted from a fuel tank into the atmosphere, by temporarily storing evaporative fuel from the fuel tank in a canister, and purging the same into the intake system of the engine. Purging of evaporative fuel into the intake system causes instantaneous enriching of an air-fuel mixture supplied to the engine. If the purged evaporative fuel amount is small, the air-fuel ratio of the mixture will then be promptly returned to a desired value, with almost no fluctuation.

However, if the purged evaporative fuel amount is large, the air-fuel ratio of the mixture fluctuates. For example, a large amount of fuel vapor can be produced in the fuel tank immediately after refueling or fill-up. In order to prevent fluctuations in the air-fuel ratio due to purging of evaporative fuel (fuel vapor) on such an occasion, there has been proposed (e.g., by Japanese Provisional Patent Publication (Kokai) No. 63-111277) a purging gas flow rate control system which reduces the purging amount of a mixture of evaporative fuel and air from the start of the engine immediately after refueling or fill-up until the speed of the vehicle in which the engine is installed reaches a predetermined value. The system also reduces the purging amount of the mixture after the vehicle speed has reached the predetermined value and until the accumulated time period over which the vehicle speed exceeds the predetermined value reaches a predetermined value.

Further, air-fuel ratio control systems are also known, which first effect purging of evaporative fuel in such a small amount as to cause almost no fluctuation of the air-fuel ratio, then detect an amount of variation of an air-fuel ratio correction coefficient applied to the feedback control of the air-fuel ratio, which is caused by the purging, next which forecast from the detected variation amount a value of the air-fuel ratio correction coefficient which should be assumed when the purged evaporative fuel amount is large, and thereafter apply the forecast value as the air-fuel ratio correction coefficient in the feedback control when the actual purged evaporative fuel amount becomes large. This reduces the fuel amount supplied to the engine, whereby fluctuations in the air-fuel ratio can be suppressed even when the purged amount is large (e.g. Japanese Provisional Patent Publication (Kokai) No. 62-131962).

However, the above conventional system is liable to fail in accurately controlling of the air-fuel ratio since the actual purged amount (the actual purged amount of the mixture of evaporative fuel and air) is not detected in controlling the flow rate of the purged mixture. More specifically, the amount of evaporative fuel produced by refueling and hence the resulting concentration of evaporative fuel in the mixture after refueling depend on an amount of fuel remaining in the fuel tank just before refueling, so that the amount of purged evaporative fuel after refueling varies. According to this conventional system, therefore, if the purging amount of the mixture is set to a relatively large value in expectation of the concentration of evaporative fuel in the mixture after refueling being relatively small, fluctuations can inevitably occur in the air-fuel ratio when a mixture with a high concentration of evaporative fuel is supplied by purging into the intake system. On the other hand, if the purging amount is set to a relatively small value in expectation of the concentration of evaporative fuel in the mixture after refueling being relatively large, the occurrence of fluctuations in the air-fuel ratio can be avoided, but the evaporative emission control cannot be performed to an adequate extent, if a mixture with a low concentration of evaporative fuel is then supplied by purging into the intake system.

Further, in the latter conventional system, the actual purged amount is not directly detected for the control of the air-fuel ratio, but the actual purged amount is estimated from the variation in the air-fuel ratio correction coefficient caused by the small purging amount, and at the same time, a variation amount in the air-fuel ratio to be caused by a large purging amount is forecast from the variation amount in the air-fuel ratio caused by the small purging amount. Therefore, the variation in the coefficient cannot be forecast accurately, which prevents accurate control of the air-fuel ratio from being carried out when purging of the evaporative fuel is effected.

Thus, both of the conventional systems can undergo fluctuations in the air-fuel ratio, resulting in degraded exhaust emission characteristics and fluctuations in engine output torque.

SUMMARY OF THE INVENTION

It is the object of the invention to provide an evaporative fuel-purging control system for an internal combustion engine, which is capable of preventing fluctuations in the air-fuel ratio to be caused by purging evaporative fuel and at the same time performing evaporative emission control to an adequate extent.

To attain the above object, the present invention provides an evaporative fuel-purging control system for an internal combustion engine having a fuel tank and an intake passage, the evaporative fuel-purging control system including a canister for adsorbing evaporative fuel generated from the fuel tank, a purging passage connected between the canister and the intake passage for purging a mixture of the evaporative fuel and air therethrough into the intake passage, and a purge control valve arranged across the purging passage for controlling the flow rate of the evaporative fuel supplied to the intake passage.

The evaporative fuel-purging control system according to the invention is characterized by comprising:

- a mass flowmeter arranged across the purging passage for measuring s flow rate of the mixture of evaporative fuel and air being purged;
- desired purging flow rate-setting means responsive to operating conditions of the engine for setting a desired flow rate of the mixture; and
- purge control means for comparing the desired flow rate of the mixture with the measured flow rate of the mixture obtained by the mass flowmeter, and controlling the opening of the purge control valve based on results of the comparison.

Preferably, the purge control means operates in a manner such that when the measured flow rate of the mixture is equal to or larger than the desired flow rate of the mixture, the opening of the purge control valve is decreased, whereas when the measured flow rate of the mixture is smaller than the desired flow rate of the mixture, the opening of the purge control valve is increased.

More preferably, the mass flowmeter has an output characteristic that an output value thereof indicative of the measured flow rate of the mixture is larger than an actual flow rate of the mixture as the concentration of the evaporative fuel in the mixture is higher.

Preferably, the desired flow rate of the mixture is determined by multiplying a flow rate QENG of air drawn into the engine which is calculated by the use of the following equation:

$$QENG = TOUT \times NE \times CEQ$$

wherein TOUT represents a fuel injection period calculated according to operating conditions of the engine, NE rotational speed of the engine, and CEQ a constant for converting the product of TOUT×NE to the flow rate QENG, by a ratio PKQH of the desired flow rate of the mixture to the flow rate QENG, the ratio PKQH being determined according to operating parameters of the engine.

More preferably, the operating parameters of the engine comprise at least the rotational speed of the engine and the pressure within the intake passage.

The above and other objects, features, and advantages of the invention will be more apparent from the ensuing detailed description taken in conjunction with the accompanying, drawings.

DETAILED DESCRIPTION

The invention will now be described in detail with reference to the drawings showing an embodiment thereof.

Figure 1:
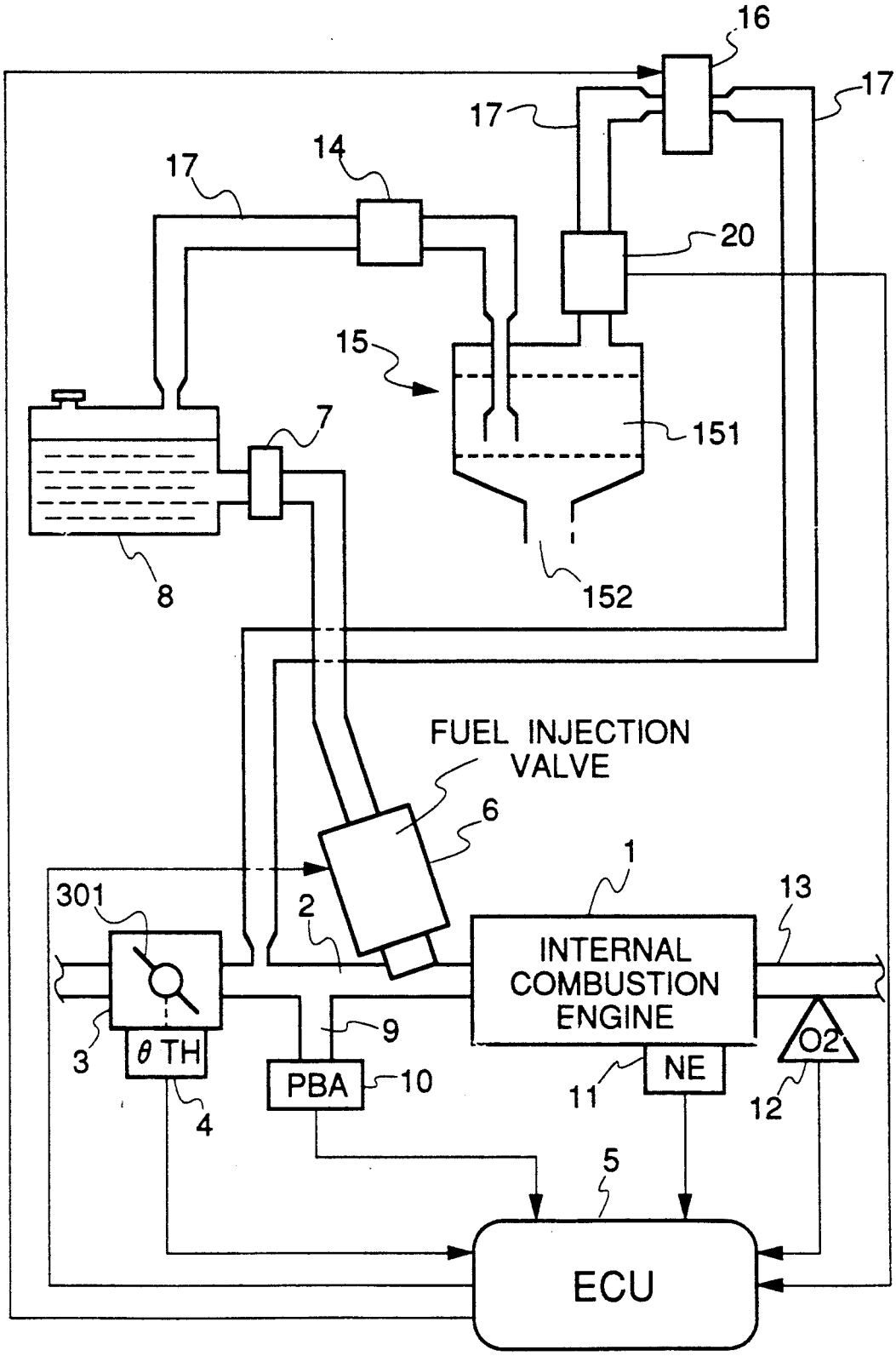
FIG. 1 is a block diagram showing the whole arrangement of a fuel supply control system for use in an internal combustion engine, including an evaporative fuel-purging control system according to an embodiment of the invention.

Referring first to FIG. 1, there is illustrated the whole arrangement of a fuel supply control system of an internal combustion engine, including an evaporative fuel-purging control system according to an embodiment of the invention. In the figure, reference numeral 1 designates an internal combustion engine which is installed in an automotive vehicle, not shown. The engine is a four-cylinder type, for instance. Connected to the cylinder block of the engine 1 is an intake pipe 2 across which is arranged a throttle body 3 accommodating a throttle valve 301 therein. A throttle valve opening ($\theta$TH) sensor 4 is connected to the throttle valve 301 for Generating an electrical signal indicative of the sensed throttle valve opening and supplying the same to an electronic control unit (hereinafter called "the ECU") 5. The ECU 5 forms the desired purging flow rate-setting means and purge control means.

Fuel injection valves 6, only one of which is shown, are inserted into the interior of the intake pipe 2 at locations intermediate between the cylinder block of the engine 1 and the throttle valve 301 and slightly upstream of respective intake valves, not shown. The fuel injection valves 6 are connected to a fuel tank 8 via a fuel pump 7, and electrically connected to the ECU 5 to have their valve opening periods controlled by signals therefrom.

On the other hand, an intake pipe absolute pressure (PBA) sensor 10 is provided in communication with the interior of the intake pipe 2 via a conduit 9 at a location immediately downstream of the throttle valve 301 for supplying an electric signal indicative of the sensed absolute pressure within the intake pipe 2 to the ECU 5.

An engine rotational speed (NE) sensor 11 is arranged in facing relation to a camshaft or a crankshaft of the engine 1, not shown. The engine rotational speed sensor 11 generates a pulse as a TDC signal pulse at each of several predetermined crank angles whenever the crankshaft rotates through 180 degrees, the pulse being supplied to the ECU 5.

An $O_2$ sensor 12 as an exhaust gas ingredient concentration sensor is mounted in an exhaust pipe 13 connected to the cylinder block of the engine 1, for sensing the concentration of oxygen present in exhaust gases emitted from the engine 1 and supplying an electrical signal indicative of the sensed value of the oxygen concentration to the ECU 5.

A conduit line (purging passage) 17 extends from an upper space in the fuel tank 8 which has an enclosed body, and opens into the intake pipe 2 at a location downstream of the throttle body 3. Arranged across the conduit line 17 is an evaporative emission control system (part of the evaporative fuel-purging control system) comprising a two-way valve 14, a canister 15 having an adsorbent 151, and a purge control valve 16 in the form of a linear control valve which has a solenoid, not shown, for driving a valve element thereof, not shown. The solenoid of the purge control valve 16 is connected to the ECU 5 and controlled by a signal supplied therefrom to change the valve opening (EACV) linearly. According to this evaporative emission control system, evaporative fuel or fuel vapor (hereinafter merely referred to as "evaporative fuel") generated within the fuel tank 8 forcibly opens a positive pressure valve, not shown, of the two-way valve 14 when the pressure of the evaporative fuel reaches a predetermined level, to flow through the valve 14 into the canister 15, where the evaporative fuel is adsorbed by the adsorbent 151 in the canister and thus stored therein. The purge control valve 16 is closed when its solenoid is not energized by the control signal from the ECU 5, whereas it is opened when the solenoid is energized, whereby negative pressure in the intake pipe 2 causes evaporative fuel temporarily stored in the canister 15 to flow therefrom together with fresh air introduced through an outside air-introducing port 152 of the canister 15 at the flow rate determined by the valve opening of the purge control valve 16 corresponding to the current amount of the signal applied thereto, through the purging passage 17 into the intake pipe 2 to be supplied to the cylinders. When the fuel tank 8 is cooled due to low ambient temperature, etc. so that negative pressure increases within the fuel tank 8, a negative pressure valve, not shown, of the two-way valve 14 is opened to return part of the evaporative fuel stored in the canister 15 into the fuel tank 8. In the above described manner, the evaporative fuel generated within the fuel tank 8 is prevented from being emitted into the atmosphere. Further, a mass flowmeter 20 is arranged across the conduit line (purging passage) 17 at a location between the canister 15 and the purge control valve 16, which detects the flow rate of a mixture of evaporative fuel and air flowing in the conduit line 17 (purging flow rate) and supplies a signal indicative of the detected value of the purging flow rate to the ECU 5. The mass flowmeter 20 may be a hot wire type which utilizes the nature of a platinum wire that when the platinum wire is heated by electric current applied thereto and at the same time exposed to a flow of gas, the platinum wire loses its heat to a decrease in temperature so that its electrical resistance decreases. Alternatively, the mass flowmeter 20 may be a thermo type comprising a thermistor of which the electrical resistance varies due to self-heating by electric current applied thereto or a change in the ambient temperature. Both types of mass flowmeters detect variation in the concentration of evaporative fuel through variations in the electrical resistance thereof.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") which executes programs for calculating a correction coefficient $VQKO_2$, referred to hereinafter, and the valve opening amount (EACV), etc., memory means storing a Ti map, referred to hereinafter, and the programs executed by the CPU and for storing results of calculations therefrom, etc., and an output circuit which outputs driving signals to the fuel injection valves 6 and the purge control valve 16.

The CPU operates in response to the above-mentioned engine parameter signals from the sensors to determine operating conditions in which the engine 1 is operating, such as an air-fuel ratio feedback control region in which the fuel supply is controlled in response to the detected oxygen concentration in the exhaust gases, and open-loop control regions, and calculates, based upon the determined operating conditions, the valve opening period or fuel injection period TOUT over which the fuel injection valves 6 are to be opened, by the use of the following equation (1) in synchronism with inputting of TDC signal pulses to the ECU 5.

$$TOUT = Ti \times KO_2 \times VQKO_2 \times K1 + K2 \quad (1)$$

where Ti represents a basic value of the fuel injection period TOUT of the fuel injection valves 6, which is read from the Ti map in accordance with the engine rotational speed NE and the intake pipe absolute pressure PBA.

$KO_2$ represents an air-fuel ratio correction coefficient whose value is determined in response to the oxygen concentration in the exhaust gases detected by the $O_2$ sensor 12, during feedback control, while it is set to respective predetermined appropriate values while the engine is in predetermined operating regions (the open-loop control regions) other than the feedback control region.

$VQKO_2$ represents a vapor flow rate-dependent correction coefficient which is determined according to the purging flow rate detected during purging of evaporative fuel.

K1 and K2 represent other correction coefficients and correction variables, respectively, which are calculated based on various engine parameter signals to such values as to optimize operating characteristics of the engine such as fuel consumption and accelerability depending on operating conditions of the engine.

The CPU 5 supplies through the output circuit, the fuel injection valves 6 with driving signals corresponding to the calculated fuel injection period TOUT determined as above, over which the fuel injection valves 6 are opened.

An actual purging flow rate Q1, which is an actual flow rate of a mixture of evaporative fuel and air flowing through the conduit line 17, is the sum of a vapor flow rate VQ (i.e., the flow rate of evaporative fuel (fuel vapor) flowing from the canister 15 after having been stored in the canister 15 and one directly flowing from the fuel tank 8 into the conduit line 17, without being temporarily adsorbed in the canister 15) and an air flow rate Q2, (i.e., the flow rate of air introduced into the conduit line 17 through the outside air-introducing port 152 of the canister 15).

Figure 3:
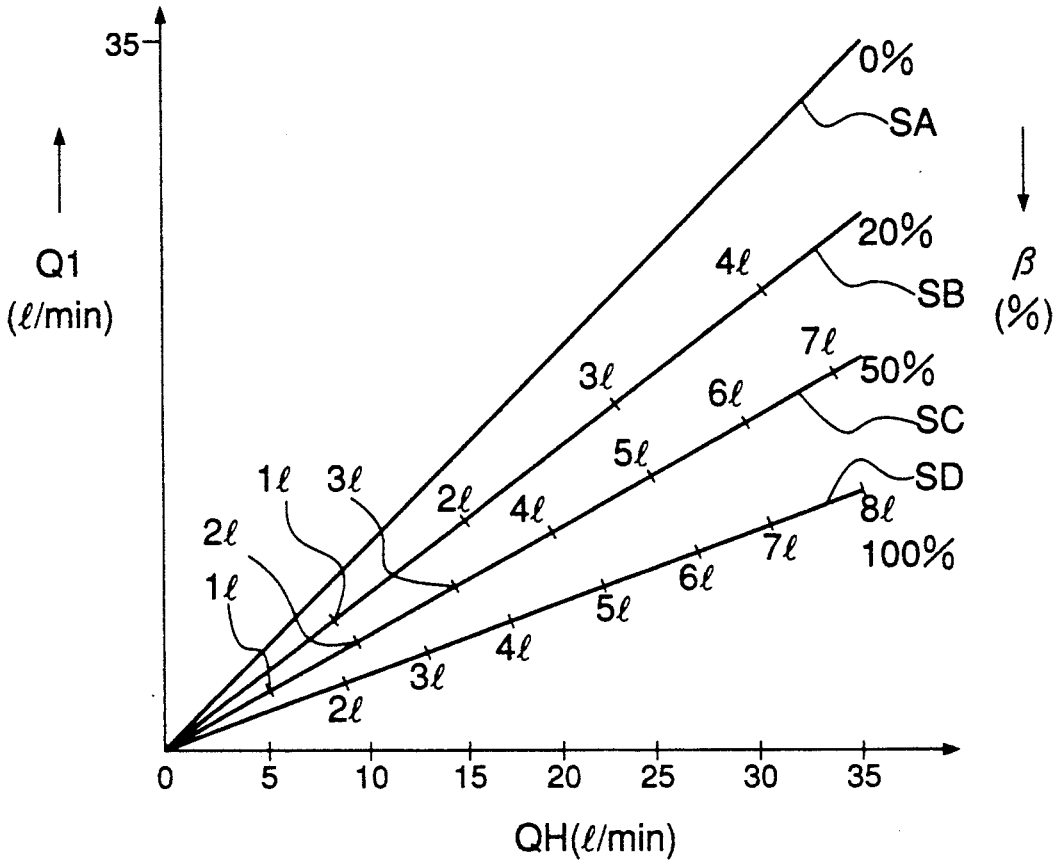
FIG. 3 is a graph showing the relationship between the measured purging flow rate and the actual purging flow rate with fuel vapor concentration as a parameter.

Next, reference is made to FIG. 3 showing the relationship between the actual purging flow rate Q1 (l/min), the vapor concentration $\beta$ (concentration of evaporative fuel in the mixture), and a measured purging flow rate QH (l/min), (i.e., the measured flow rate of the mixture). In the figure, the abscissa represents the measured purging flow rate QH which is indicated by the flowmeter 20, and the ordinate represents the actual purging flow rate Q1. Further, SA represents a characteristic curve indicative of Q1/QH in the case where the vapor concentration is 0%, (i.e., the mixture is pure air), SB a curve of the same kind in the case where the vapor concentration is 20%, SC a curve of the same kind in the case where the vapor concentration is 50%, and SD a curve of the same kind in the case where the vapor concentration is 100%. When the vapor concentration is 0%, the measured purging flow rate QH indicated by the mass flowmeter 20 is equal to the actual purging flow rate Q1. That is, if QH=35 l/min, Q1=35 l/min, for instance. When the vapor concentration is 100%, however, the measured purging flow rate QH indicated by the mass flowmeter 20 is not equal to the actual purging flow rate Q1. That is, if QH=35 l/min, Q1=8 l/min, for instance. In short, the measured purging flow rate QH becomes larger than the actual purging flow rate Q1 by an increased amount as the vapor concentration becomes higher.

The present invention utilizes the above-mentioned output characteristic of the mass flowmeter, that is, as the density of a measured gas (in the present case, vapor concentration) varies (increases), the output value (indicated value) changes (increases) at different (greater) rates relative to the actual flow rate.

Figure 4:
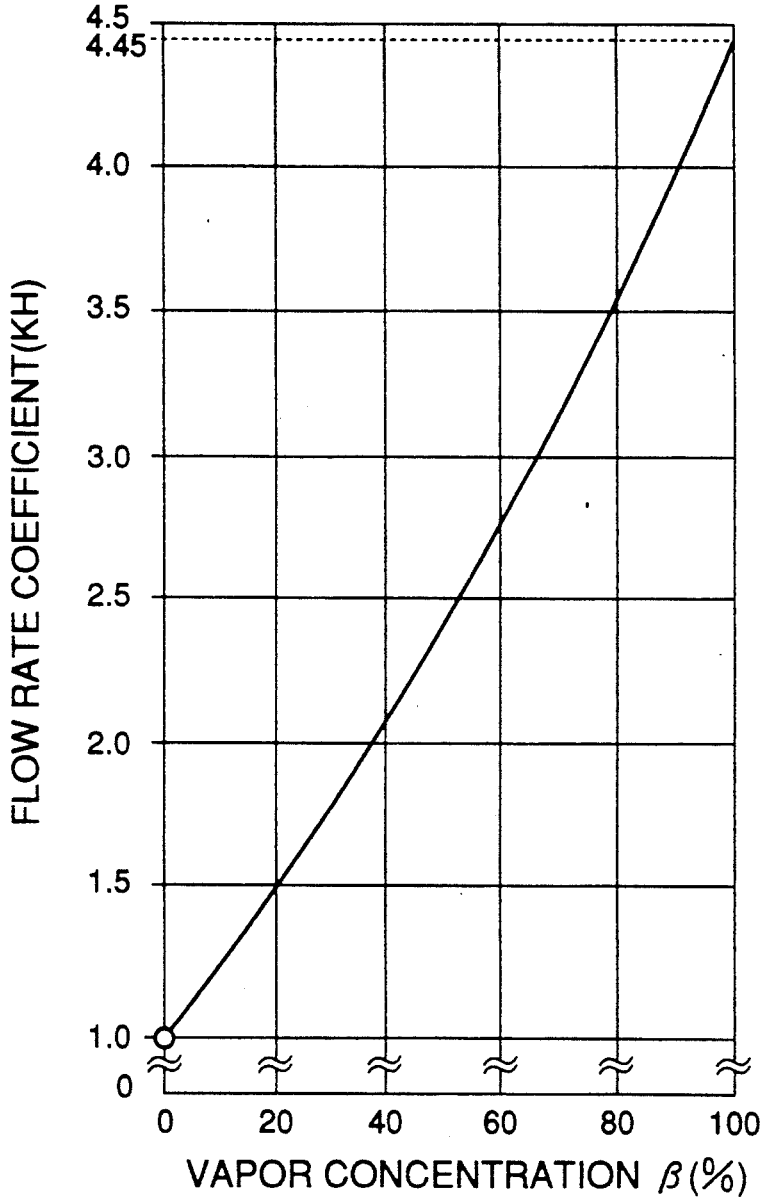
FIG. 4 is a graph showing the relationship between the concentration of fuel vapor and a flow rate coefficient KH.

The above-mentioned actual purging flow rate Q1 can be expressed by the following equation:

$$Q1 = QH/KH \quad (2)$$

where KH represents a flow rate coefficient determined by the vapor concentration $\beta$ in the mixture, which is experimentally obtained depending on the varying output characteristic of the mass flowmeter 20 described above. As shown in FIG. 4, KH increases with increase in the vapor concentration $\beta$. For example, assuming that the measured purging flow rate QH is 35 l/min, if KH=1 (a value assumed when $\beta$=100%), then Q1=35 l/min, whereas if KH=4.45 (a value assumed when $\beta$=100%), then Q1=7.87 l/min. In other words, as described hereinabove, when the purged mixture of the evaporative fuel and air is high in vapor concentration $\beta$, the measured purging flow rate QH assumes a larger value than the actual purging flow rate Q1. The equation can be changed to QH=Q1×KH, which shows that the measured purging flow rate QH is equal to a flow rate obtained by multiplying the actual purging flow rate Q1 by a weighting factor (KH) corresponding to the vapor concentration $\beta$. Therefore, if the purge control valve 16 is controlled based on the measured purging flow rate QH, it is possible to control the the flow rate Q1 of the mixture such that it is decreased when the vapor concentration $\beta$ becomes higher, whereas it is increased when the vapor concentration $\beta$ becomes lower, enabling to keep constant the air-fuel ratio of a mixture supplied via the intake system to the engine.

Figure 2:
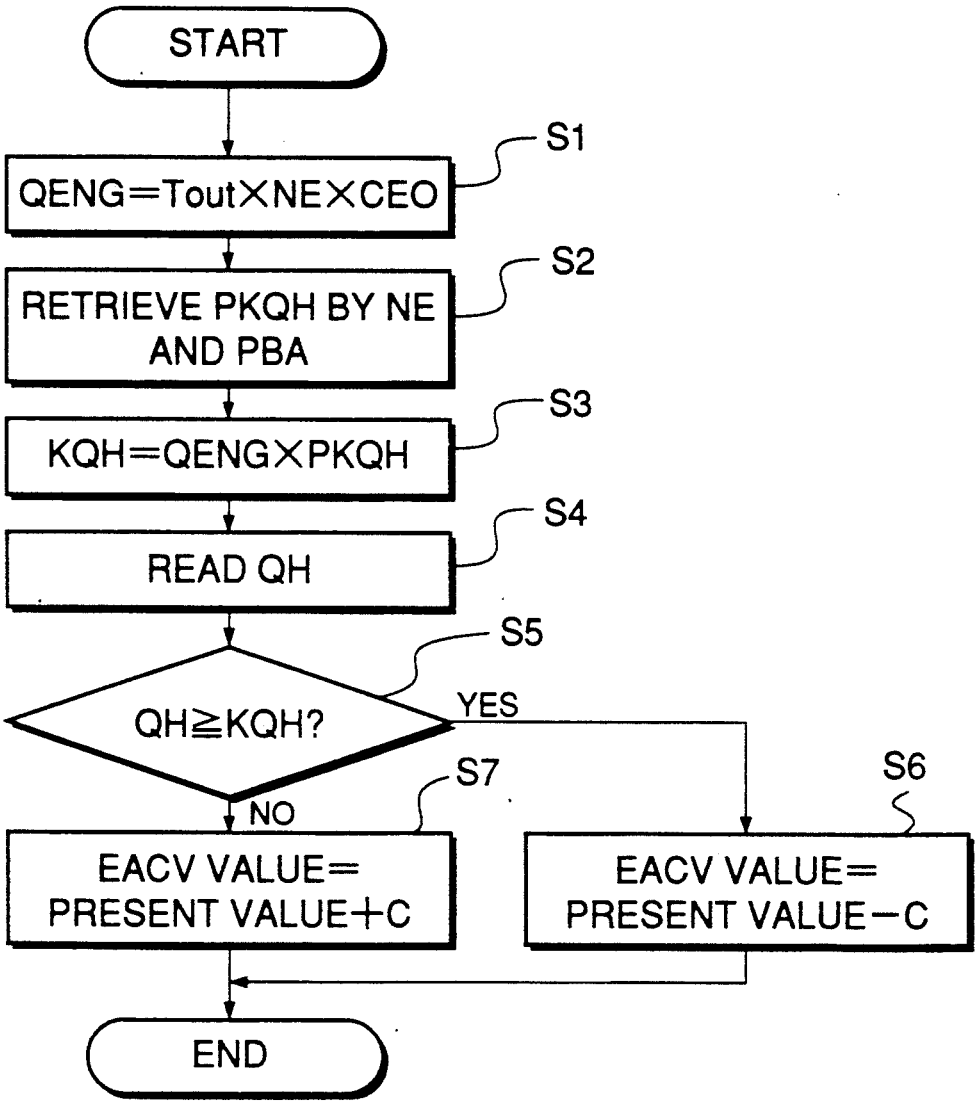
FIG. 2 is a flowchart of a program for carrying out evaporative fuel-purging control by the evaporative fuel-purging control system according to the invention.

FIG. 2 shows a program for controlling the purge control valve in the above described manner. This program is executed by the CPU of the ECU 5 whenever a predetermined time period elapses.

First, at a step S1, a flow rate QENG of air drawn into the engine 1 or intake air is calculated by the use of the following equation (3):

$$QENG = TOUT \times NE \times CEQ \quad (3)$$

where TOUT is the fuel injection period calculated by the equation (1), and CEQ is a constant for converting the product of TOUT×NE to the flow rate QENG of intake air.

At a step S2, a desired ratio PKQH of the purging flow rate to the flow rate QENG of intake air supplied to the engine is calculated from a PKQH map according to the detected engine rotational speed NE and intake pipe absolute pressure PBA. The PKQH map is one in which values of the desired ratio PKQH are set corresponding, respectively, to combinations of a plurality of values of the engine rotational speed NE and a plurality of values of the intake pipe absolute pressure PBA.

At a step S3, a desired purging flow rate KQH is calculated by applying the flow rate QENG of intake air and the desired ratio PKQH to the following equation (4):

$$KQH = QENG \times PKQH \quad (4)$$

At a step S4, a value of the measured purging flow rate QH is obtained by the mass flowmeter 20, and the ECU 5 reads the value of the measured flow rate QH obtained by the mass flowmeter 20.

At a step S5, it is determined whether or not the measured purging flow rate QH is equal to or higher than the desired purging flow rate KQH.

If the answer to the question of the step S5 is affirmative (Yes), i.e. if QH≧KQH, the control amount EACV corresponding to the valve opening of the purge control valve 16 is decreased by a predetermined value C from the present value at a step S6, followed by terminating the present program.

On the other hand, if the answer to the question of the step S5 is negative (No), i.e. if QH<KQH, the control amount EACV is increased by the predetermined value C from the present value at a step S7, followed by terminating the present program.

As described in detail above, the air-fuel ratio of the mixture supplied to the engine via the intake system thereof can be controlled to desired values responsive to operating conditions of the engine by controlling the valve opening of the purge control valve 16 based on the measured purging flow rate QH (as at the steps S6, S7), to thereby prevent the air-fuel ratio from fluctuating when purging of evaporative fuel is carried out, while allowing evaporative fuel emission control to be performed to an adequate extent.

What is claimed is:

1. In an evaporative fuel-purging control system for an internal combustion engine having a fuel tank and an intake passage, said evaporative fuel purging control system including a canister for adsorbing evaporative fuel generated from said fuel tank, a purging passage connecting between said canister and said intake passage for purging a mixture of said evaporative fuel and air therethrough into said intake passage, and a purge control valve arranged across said purging passage for controlling the flow rate of said evaporative fuel supplied to said intake passage, the improvement comprising:

a mass flowmeter means arranged across said purging passage, for determining an actual flow rate of said mixture of evaporative fuel and air being purged, said mass flowmeter means including output characteristic determining means for determining an output characteristic of said mass flowmeter means so as to define a predetermined relationship between the actual flow rate and a measured flow rate of said mixture from said mass flowmeter means based on the concentration of evaporative fuel in the mixture such that said measured flow rate of said mixture varies relative to the actual flow rate of said mixture as the concentration of said evaporative fuel in said mixture varies wherein the output characteristic determining means of said mass flowmeter means has defined the output characteristic such that said measured flow rate of said mixture is larger than the actual flow rate of said mixture as the concentration of said evaporative fuel in said mixture increases;

desired purging flow rate-setting means responsive to operating conditions of said engine for setting a desired flow rate of said mixture; and purge control means for comparing said desired flow rate of said mixture with said measured flow rate of said mixture obtained by said mass flowmeter means, and for controlling opening of said purge control valve based on results of the comparison.

2. An evaporative fuel-purging control system according to claim 1, wherein said purge control means operates in a manner such that when said measured flow rate of said mixture is equal to or larger than said desired flow rate of said mixture, said opening of said purge control valve is decreased, whereas when said measured flow rate of said mixture is smaller than said desired flow rate of said mixture, said opening of said purge control valve is increased.

3. In an evaporative fuel-purging control system for an internal combustion engine having a fuel tank and an intake passage, said evaporative fuel purging control system including a canister for adsorbing evaporative fuel generated from said fuel tank, a purging passage connecting between said canister and said intake passage for purging a mixture of said evaporative fuel and air therethrough into said intake passage, and a purge control valve arranged across said purging passage for controlling the flow rate of said evaporative fuel supplied to said intake passage, the improvement comprising:

a mass flowmeter means arranged across said purging passage, for measuring a flow rate of said mixture of evaporative fuel and air being purged;

desired purging flow rate-setting means responsive to operating conditions of said engine for setting a desired flow rate of said mixture; and purge control means for comparing said desired flow rate of said mixture with said measured flow rate of said mixture obtained by said mass flowmeter, and for controlling opening of said purge control valve based on results of the comparison, wherein said desired flow rate of said mixture is determined by multiplying a flow rate QENG of air drawn into said engine which is calculated by the use of the following equation:

$$QENG = TOUT \times NE \times CEQ$$

wherein TOUT represents a fuel injection period calculated according to operating conditions of said engine, NE rotational speed of said engine, and CEQ a constant for converting the product of TOUT×NE to said flow rate QENG, by a ratio PKQH of said desired flow rate of said mixture to said flow rate QENG, said ratio PKQH being determined according to operating parameters of said engine.

4. An evaporative fuel-purging control system according to claim 3, wherein said operating parameters of said engine comprise at least rotational speed of said engine and pressure within said intake passage.

5. An evaporative fuel-purging control system for an internal combustion engine having a fuel tank and an intake passage, said evaporative fuel purging control system comprising:

a canister for adsorbing evaporative fuel generated from the fuel tank;

a first purging passage connected between said canister and the fuel tank;

a second purging passage connected between said canister and the intake passage, said first and second purging passages being formed in conjunction with said canister so as to purge a mixture of evaporative fuel and air therethrough into the intake passage;

a purge control valve arranged across said second purging passage for controlling the flow rate of said evaporative fuel supplied to said intake passage;

mass flowmeter means connected between said canister and said purge control valve, for determining an actual flow rate of the mixture of evaporative fuel and air being purged based on variations in a concentration of evaporative fuel in the mixture, said mass flowmeter means including output characteristic determining means for determining an output characteristic of said mass flowmeter means so as to define a predetermined relationship between the actual flow rate and a measured flow rate of said mixture from said mass flowmeter means based on the concentration of evaporative fuel in the mixture such that the measured flow rate of the mixture varies relative to the actual flow rate of the mixture as the concentration of said evaporative fuel in the mixture varies wherein the output characteristic determining means of said mass flowmeter means has defined the output characteristic such that the measured flow rate of the mixture is larger than the actual flow rate of the mixture as the concentration of the evaporative fuel in the mixture increases;

desired purging flow rate-setting means responsive to operating conditions of the engine, for setting a desired flow rate of the mixture; and purge control means for comparing the desired flow rate of said mixture with the measured flow rate of said mixture obtained by said mass flowmeter means, and for controlling opening of said purge control valve based on results of the comparison.

6. An evaporative fuel-purging control system according to claim 5, wherein said purge control means is further for decreasing the opening of said purge control valve when the measured flow rate of the mixture is equal to or larger than the desired flow rate of the mixture, and for increasing the opening of said purge control valve when the measured flow rate of the mixture is smaller than the desired flow rate of the mixture.

7. An evaporative fuel-purging control system according to claim 5, wherein said desired flow rate of the mixture is determined by multiplying a flow rate QENG of air drawn into the engine which is calculated by the use of the following equation:

$$QENG = TOUT \times NE \times CEQ$$

wherein TOUT represents a fuel injection period calculated according to operating conditions of the engine, NE rotational speed of the engine, and CEQ a constant for converting the product of TOUT×NE to the flow rate QENG, by a ratio PKQH of the desired flow rate of the mixture to the flow rate QENG, the ratio PKQH being determined according to operating parameters of the engine.

8. An evaporative fuel-purging control system according to claim 7, wherein said operating parameters of the engine comprise at least rotational speed of said engine and pressure within said intake passage.

9. In an evaporative fuel-purging control system according to claim 1, wherein said desired flow rate of said mixture is determined by multiplying a flow rate QENG of air drawn into said engine which is calculated by the use of the following equation:

$$QENG = TOUT \times NE \times CEQ$$

wherein TOUT represents a fuel injection period calculated according to operating conditions of said engine, NE rotational speed of said engine, and CEQ a constant for converting the product of TOUT×NE to said flow rate QENG, by a ratio PKQH of said desired flow rate of said mixture to said flow rate QENG, said ratio PKQH being determined according to operating parameters of said engine.

10. An evaporative fuel-purging control system according to claim 9, wherein said operating parameters of said engine comprise at least rotational speed of said engine and pressure within said intake passage.

* * * * *